US005384513A

United States Patent [19]

Ji

[11] Patent Number: 5,384,513

[45] Date of Patent: Jan. 24, 1995

[54] CATHODE RAY TUBE WITH IMPROVED FOCUSING CHARACTERISTICS

[75] Inventor: Seong-hun Ji, Pusan, Rep. of Korea

[73] Assignee: Samsung Electron Devices Co., Ltd., Kyungki, Rep. of Korea

[21] Appl. No.: 998,123

[22] Filed: Dec. 29, 1992

[30] Foreign Application Priority Data

Dec. 30, 1991 [KR] Rep. of Korea ..... 91-25431

[51] Int. Cl.[6] ..... H01J 29/46

[52] U.S. Cl. ..... 313/442; 313/412; 313/414; 313/425; 335/210

[58] Field of Search ..... 313/412, 414, 425, 442; 335/210

[56] References Cited

U.S. PATENT DOCUMENTS

| | | | |
|---|---|---|---|
| 2,372,443 | 3/1945 | Marton | 313/442 |
| 4,345,183 | 8/1982 | Fukuda | 313/412 |
| 4,439,710 | 3/1984 | Osakabe et al. | 313/414 |
| 4,460,844 | 7/1984 | Sakurai et al. | 313/414 |
| 4,473,773 | 9/1984 | Sakurai et al. | 313/414 |
| 4,490,644 | 12/1984 | Shimoma et al. | 313/414 X |
| 5,254,903 | 10/1993 | Jo et al. | 313/414 |
| 5,256,933 | 10/1993 | Jeon | 313/414 |

*Primary Examiner*—Donald J. Yusko
*Assistant Examiner*—Vip Patel
*Attorney, Agent, or Firm*—Leydig, Voit & Mayer

[57] ABSTRACT

Disclosure relates to a cathode ray tube formed in the neck portion of a funnel, which comprises an electron gun including a cathode, a control electrode and a screen electrode constituting a triode, and a magnetic substance formed between the cathode and the control electrode to focus the electron beam on the control electrode, so that the electron beam emitted from the cathode ray tube is focused toward an electron beam passing hole of the control electrode to improve the focussing characteristics and current density of the electron beam.

8 Claims, 3 Drawing Sheets

CATHODE RAY TUBE WITH IMPROVED FOCUSING CHARACTERISTICS

BACKGROUND OF THE INVENTION

The present invention is related to a cathode ray tube, and more particularly cathode ray tube wherein the divergence angle of an electron beam emitted from a cathode of an electron gun is decreased by a magnetic field, and the electron beam is accelerated to improve the current density of the electron beam passing through the electron beam passing holes of a control electrode.

Generally, a cathode ray tube comprises a panel having a shadow mask frame assembly therein, and a funnel having a neck portion which houses an electron gun. The electron gun mounted in the neck portion of the funnel as shown in FIG. 1, comprises a triode as the source of an electron beam. The triode comprises a cathode 11, a control electrode 12 and a screen electrode 13, and a main lens including a focus electrode 14 and final accelerating electrode 15, and a bead glass 16 supporting the whole structure.

In the electron gun of a cathode ray tube constructed as above, as a predetermined voltage is supplied to each electrode, a cathode lens is formed between a cathode 11 and a control electrode 12, a pre-focus lens is formed between a screen electrode 13 and a focus electrode 14, and a main lens is formed between a focus electrode 14 and a final accelerating electrode 15. Accordingly, the electron beam emitted from cathode 11 is preliminarily focused and accelerated in the cathode lens and pre-focus lens, and then finally focused and accelerated by the main lens to proceed toward a fluorescent layer at a high speed.

However, as shown in FIG. 2, since tile diameter of an electron beam passing hole 12*a* of control electrode 12 is smaller than that of a base metal 11*a* of cathode 11, the electron beam emitted from electron-emitting material of cathode 11 does not smoothly proceed to electron beam passing hole 12*a*, and a considerable amount of the electron beam collides with control electrode 12 and is eliminated. Also, since 0 V and 400 V are supplied to control electrode 12 and screen electrode 13, respectively, the divergence angle of some of the electron beams emitted from the electron-emitting material is enlarged by the magnetic field formed between control electrode 12 and screen electrode 13. Therefore, tile electron beam is affected by a large spherical difference when passing through the cathode lens and pre-focus lens.

SUMMARY OF THE INVENTION

The object of the present invention is to provide a cathode ray tube which improves the aim of the electron beam so as to focus the electron beam emitted from the cathode toward the electron beam passing hole of the control electrode, and forms a strong electron beam of good quality.

Another object of the present invention is to provide a cathode ray tube which realizes a good quality image having high luminance.

To achieve the above objects of the present invention, a cathode ray tube is provided which comprises an electron gun including a cathode, a control electrode and a screen electrode which constitute a triode, a funnel having a neck portion receiving the electron gun, the neck portion having an inner wall and a panel connected to the funnel to form a vacuum container. Also provided is a magnetic substance surrounding the path of a thermal electron emitted from the cathode, positioned between the cathode and the control electrode, said magnetic substance forming a radial magnetic field having a central axis including an inclination angle within the range of 20° to 40° with respect to the central axis of said electron gun, said magnetic substance focusing the electron beam emitted from the cathode toward the electron beam passing hole of the control electrode.

In the present invention, the magnetic field of the magnetic substance can be formed so as to be inclined within the range of 20° to 40° in respect to the central axis of electron beam procession, with the desirable angle being 30°. It is desirable to mount the magnetic substance on the outer surface of the neck, but it can be provided on the neck's inner surface, as the case may be.

BRIEF DESCRIPTION OF THE DRAWINGS

Further features and advantages will become more apparent from the following and more particular description of the preferred embodiment of the invention as illustrated in the accompanying drawings in which the same reference characters generally refer to like parts throughout the views, and in which.

DETAILED DESCRIPTION OF THE INVENTION

A cathode ray tube of the present invention, like the conventional one, comprises a panel formed with a fluorescent layer screen therein, a funnel having a neck portion receiving housing an electron gun, and a shadow mask assembly formed between the electron gun and the screen.

Figure 1:
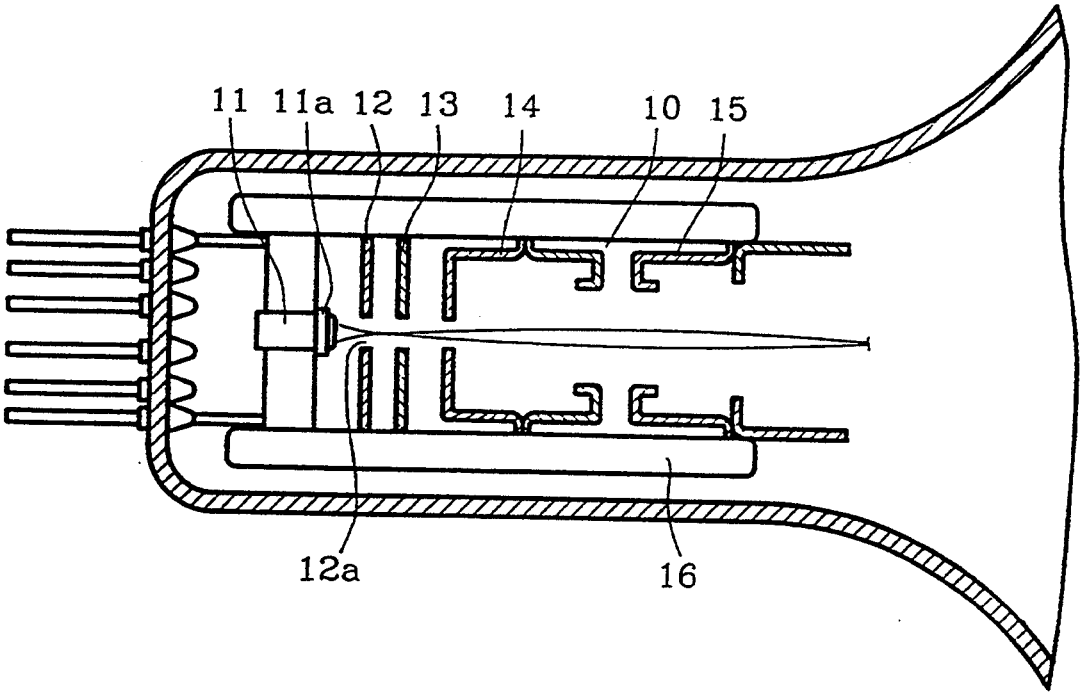
FIG. 1 (PRIOR ART)
FIG. 1 is a cut-away sectional view of the neck portion of a conventional cathode ray tube.
Figure 2:
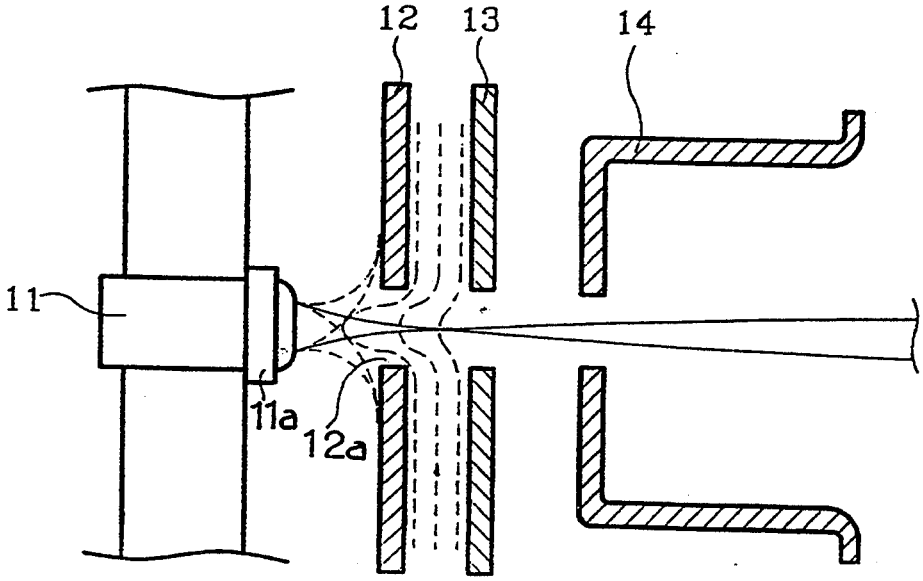
FIG. 2 (PRIOR ART)
FIG. 2 is an extracted and enlarged sectional view of an electron gun illustrated in FIG. 1.
Figure 3:
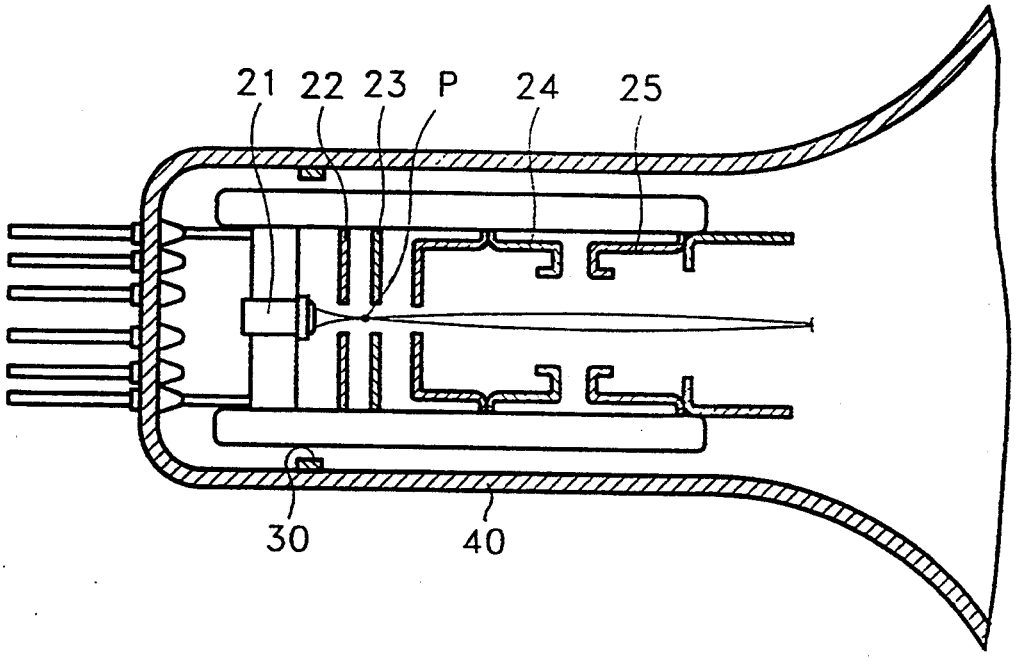
FIG. 3 is a cut-away sectional view of the neck portion of a cathode ray tube according to the present invention.
Figure 5:
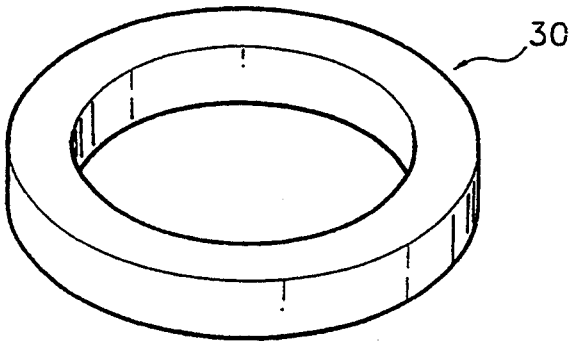
FIG. 5 is a perspective view of a magnetic substance used in the cathode ray tube of the present invention.

FIG. 3 shows the extracted neck 40 formed in the rear of the funnel and having the characteristic elements of the present invention. In the interior of neck 40, an electron gun is mounted in which a cathode 21, a control electrode 22 and a screen electrode 23 are formed constituting a triode. A focus electrode 24 and a final accelerating electrode 25 are respectively positioned downstream from the screen electrode 23 and constitute a main lens. A magnetic substance 30 is formed between cathode 21 and control electrode 22 and placed on the inner walls of the neck 40. Magnetic substance 30, is preferably an anisotropic ferrite or a rare earth plastic magnet. Magnetic substance 30 is also preferably shaped like a ring formed along the inner surface of neck 40, as shown in FIG. 5.

Figure 4:
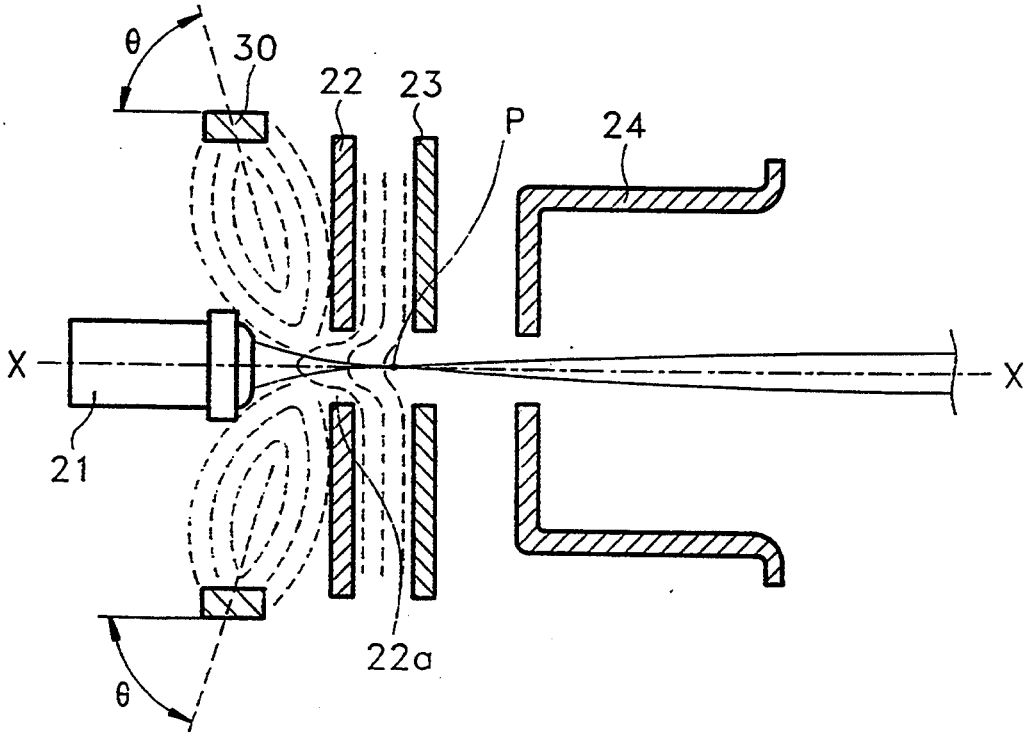
FIG. 4 is an extracted and enlarged sectional view of an electron gun illustrated in FIG. 3 for showing the magnetic field and electric field formed in the triode.
Figure 8:
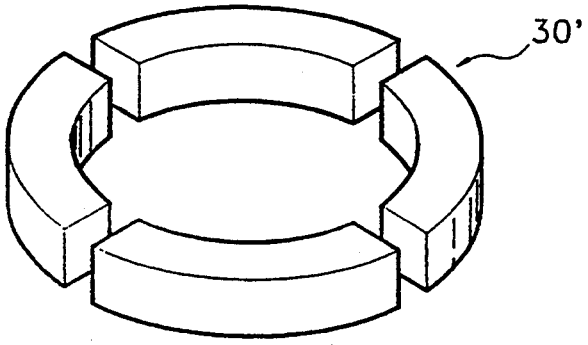
FIG. 8 is a perspective view of another type of a magnetic substance used in the cathode ray tube of the present invention.

As shown in FIG. 8, magnetic substance 30 can be divided into several pieces, and can be formed on the outer surface of the neck of the cathode ray tube. Referring to FIG. 4, given that the incident angle of the electron beam emitted from the electron-emitting material is about 30° at the crossover point, the inclination angle $\theta$ of magnetic field created by magnetic substance 30 in respect to the central axis X—X of an electron gun, is desirably within the range of 20° to 40°. Here, in order to focus the electrons toward the control electrode, the side adjacent to the cathode should be an N pole, and the other side should be an S pole. Accordingly, the outer surface of the ring-shaped magnetic substance which is contiguous to the inner surface of the neck 40 is an S pole, and the inner surface is an N pole.

Now, the operation of the cathode my tube according to the present invention will be explained.

When a predetermined voltage is supplied to each electrode of the electron gun mounted in neck 40 of the cathode ray tube, a cathode lens is formed between cathode 21 and control electrode 22, a pre-focus lens is formed between screen electrode 23 and focus electrode 24, and a main lens is formed between focus electrode 24 and final accelerating electrode 25. Accordingly, the thermal electrons emitted from the electron-emitting material of cathode 21 are preliminarily focused and accelerated in the cathode lens and pre-focus lens to be formed into a beam, and then finally focussed and accelerated in the main lens to proceed to the fluorescent layer screen.

Figure 6:
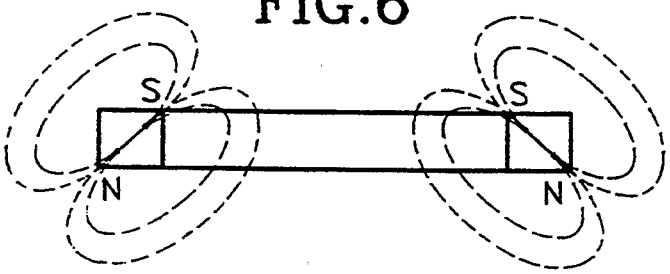
FIG. 6 is a sectional view showing the magnetic polarity of the magnetic substance illustrated in FIG. 5.
Figure 7:
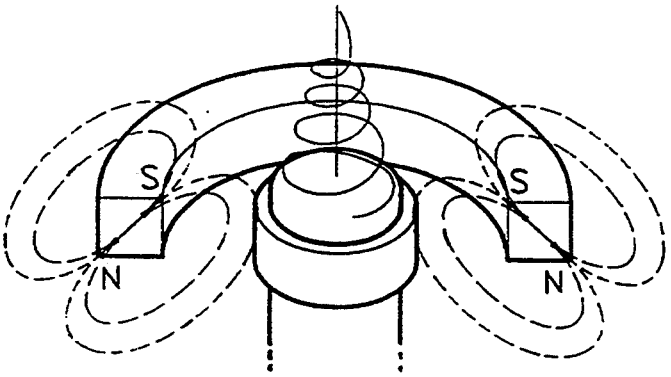
FIG. 7 is an extracted perspective view showing a control condition of an electron beam emitted from the cathode ray tube placed in the center of the magnetic substance, which is controlled by the magnetic substance illustrated in FIG. 5.

In the cathode my tube, a magnetic field is formed between cathode 21 and control electrode 22, which focuses the diverging thermal electrons among the thermal electrons emitted from the cathode into the central part by ring-shaped magnetic substance 30 placed on the inner surface of the neck. As shown in FIGS. 4, 6 and 7, the magnetic field is formed so as to be inclined at a predetermined angle in respect to center axis X of electron beam procession. The thermal electrons emitted from the cathode surface adjacent to central axis X, move linearly through central axis X by the magnetic field, and pass through the control electrode. A repulsive force in the direction of central axis is exerted on most of the thermal electrons by the magnetic field, so that the electrons are propelled toward the control electrode through a spiraling conic orbit. Therefore, most of the thermal electrons are focused into the control electrode by the magnetic field of magnetic substance 30, improving the beam's current density which enhances luminance and focussing characteristics of the screen. Particularly, the central axis of the magnetic field of magnetic substance 30 is formed in nearly the same direction as that of the incident angle, at a crossover point P of the electron beam, so that the electron beam emitted toward the periphery of cathode 21 is focused into the electron beam passing hole of control electrode 22. Accordingly, the electron emitted from cathode 21 is directed toward the electron beam passing hole of control electrode 22, so that the beam current density of the electron beam passing through electron beam passing hole 22*a* of control electrode 22 is improved. Also, the divergence angle of the electron emitted from electron-emitting material of cathode 21 becomes constant, so that the amount of the electron beam passing through the peripheries of the main lens and the pre-focus lens can be minimized, and each electron beam becomes less influenced by the spherical differences thereof.

In the cathode ray tube of the present invention, a magnetic substance is formed on the neck's inner surface and corresponds to the portion between the cathode and control electrode of the electron gun, so that the electron beam emitted from the cathode is effectively focused on the electron beam passing hole of the control electrode. Therefore, the beam current density is improved and the luminance and focusing characteristics of the image are enhanced.

Having described a preferred embodiment of the present invention, it will be clear to those skilled in the art that modifications and alternatives to the disclosed apparatus exist within the scope and spirit of the present invention. Accordingly, it is intended to limit the scope of the present invention only as indicated in the following claims.

What is claimed is:

1. A cathode ray tube comprising:

an electron gun including a triode comprising a cathode, a control electrode and a screen electrode;

a funnel having a neck portion for housing the electron gun, the neck portion having an inner wall and a panel connected to said funnel to form a vacuum container;

a magnetic substance attached to the inner wall of the neck portion positioned between said cathode and said control electrode, said magnetic substance forming a radial magnetic field having a central axis including an inclination angle within the range of 20° to 40° with respect to the central axis of said electron gun, said magnetic substance focusing electron beam emitted from said cathode toward an the electron beam passing hole of said control electrode.

2. A cathode ray tube as claimed in claim 1, wherein said magnetic substance is ring-shaped.

3. A cathode ray tube as claimed in claim 1, wherein said magnetic substance is an anisotropic ferrite.

4. A cathode ray tube as claimed in claim 2, wherein said magnetic substance is an anisotropic ferrite.

5. A cathode ray tube comprising:

an electron gun including a triode comprising a cathode which emits thermal electrons, a control electrode and a screen electrode;

a funnel having a neck portion for housing the electron gun, the neck portion having an inner wall and an outer wall;

a magnetic deflection member attached to the inner wall of the neck portion surrounding the path of thermal electrons emitted from said cathode and positioned between said cathode and said control electrode such that a portion of the magnetic deflection member that is adjacent said cathode is a north pole, said magnetic deflection member forming a radial magnetic field having a central axis including an inclination angle within the range of 20° to 40° with respect to the central axis, said magnetic reflection member focusing the electron beam emitted from said cathode toward an electron beam passing hole of said control electrode.

6. A cathode ray tube as claimed in claim 5, wherein said magnetic deflection member is ring shaped.

7. A cathode ray tube as claimed in claim 5 wherein said magnetic deflection member comprises an anisotropic ferrite.

8. A cathode ray tube as claimed in claim 5 wherein said magnetic deflection member comprises a rare earth plastic magnet.

* * * * *